US008194385B1

(12) United States Patent
Miller et al.

(10) Patent No.: US 8,194,385 B1
(45) Date of Patent: Jun. 5, 2012

(54) PRECISION ALIGNMENT SYSTEM

(75) Inventors: Kent S. Miller, Brookings, SD (US); Mark D. Dennis, Dell Rapids, SD (US); Nathan L. Nearman, Brookings, SD (US)

(73) Assignee: Daktronics, Inc., Brookings, SD (US)

( * ) Notice: Subject to any disclaimer, the term of this patent is extended or adjusted under 35 U.S.C. 154(b) by 1071 days.

(21) Appl. No.: 12/151,021

(22) Filed: Apr. 30, 2008

(51) Int. Cl.
*F23Q 7/00* (2006.01)

(52) U.S. Cl. ..... 361/249; 361/250

(58) Field of Classification Search ..... 248/346.01, 248/346.03, 346.06, 356.5; 29/281.1; 269/43, 269/95, 289, 900
See application file for complete search history.

(56) References Cited

U.S. PATENT DOCUMENTS

| | | | | |
|---|---|---|---|---|
| 3,808,584 | A * | 4/1974 | Neff | 439/563 |
| 5,026,033 | A * | 6/1991 | Roxy | 269/45 |
| 5,305,992 | A * | 4/1994 | Kish | 269/51 |
| 5,305,993 | A * | 4/1994 | Staeb | 270/37 |
| 7,774,968 | B2 * | 8/2010 | Nearman et al. | 40/605 |

* cited by examiner

*Primary Examiner* — Amy Sterling
*Assistant Examiner* — Erin W Smith
(74) *Attorney, Agent, or Firm* — Schwegman, Lundberg & Woessner P.A.

(57) ABSTRACT

A precision alignment system for the alignment of modular frames of an electronic sign including a plurality of precision alignment mechanisms which are mounted to the outer panels of the modular frames and an alignment fixture having a plurality of configurable jig towers. The configurable jig towers include moveable components which are used to precisionally align the outer contact surfaces of contact blocks in the precision alignment mechanisms for subsequent intimate contact between other like outer contact surfaces of contact blocks in the precision alignment mechanisms of horizontally and vertically adjacent modular frames.

17 Claims, 17 Drawing Sheets

PRECISION ALIGNMENT SYSTEM

CROSS REFERENCES TO RELATED APPLICATIONS

None.

BACKGROUND OF THE INVENTION

1. Field of the Invention

The present invention is for a sign frame alignment system and, more particularly, it is for a precision alignment system for modular frames of an electronic sign where the modular frames serve, in part, as a mounting structure for LED panels. Adjustable precision alignment mechanisms of the present invention are mounted on the modular frames and are pre-adjusted on an external alignment fixture in order to provide for a close tolerance single modular frame alignment prior to the vertical and/or horizontal adjacent positioning of multiple modular frames. Communication of components of the pre-aligned precision alignment mechanisms provide for a true and regular alignment of the modular frames and correspondingly of the LED display panels known in the art which display panels can be secured to the aligned modular frames to collectively form an electronic sign.

2. Description of the Prior Art

The problem with assembling electronic LED displays, especially transportable displays, is that the seams between the LED panels of the vertically and horizontally adjacent LED modular support frames are noticeably visible unless extraordinary procedures or concepts are implemented. The manufacturing process can only be expected to achieve a given tolerance fitting level whereby geometric uneveness will result in undesirable, uneven or unequal gaps between the LED display panels resulting in a poor visual quality. One prior art alignment method involved the placing of shims in between support frame members to consequently provide for an aligned LED display panel spacing, but shims are difficult to place and are labor intensive. Another alignment method involved shifting the LED display panel on the face of a support frame. The display panels have a very limited distance that they can be shifted and such adjustment is very labor intensive. Another method involved the use of field adjustable screws so that an LED display panel could be built in the field and then modified to remove any seams. This also is very time consuming and labor intensive and is not repeatable from setup-to-setup since the locations of various display elements may be different at different venues.

The present invention provides a way for a predetermined, uniformly, dimensioned spacing about a modular frame, thereby providing a precise uniform geometry and a precise uniform dimensioning for each of a plurality of modular frames so that very accurate and precise sign displays can be created without any visible seams. Precision alignment mechanisms of the present invention located on a suitable modular frame are factory set using an alignment fixture of the present invention and require no field adjustment.

SUMMARY OF THE INVENTION

The general purpose of the present invention is to provide a precision alignment system to facilitate the alignment of modular frames for an electronic sign including the use of multiple precision alignment mechanisms and an alignment fixture. According to one or more embodiments of the present invention, there is provided a precision alignment system having a plurality of adjustable precision alignment mechanisms and an alignment fixture for use with the modular frames of an electronic sign. In the use of the present invention, the precision alignment mechanisms are distributed and secured about the modular frames, each modular frame of which can be incorporated into the formation of an electronic sign. Each modular frame can provide a support for one or more LED display modules and associated components known in the art. Modular frames and LED modules mounted thereupon can be situated in intimate vertical and horizontal alignment in order to collectively form an electronic sign. In addition to the plurality of precision alignment mechanisms of the present invention, there is also provided an alignment fixture having components which aligningly communicate during an alignment process with the modular frame mounted precision alignment mechanisms prior to use in association with an electronic sign.

One significant aspect and feature of the present invention is a precision alignment system for modular frames which system can be used in an electronic sign for providing precise uniformity when used in association with a plurality of other like modular frames.

Another significant aspect and feature of the present invention is the use of a plurality of precision alignment mechanisms which can be secured to the periphery of an electronic sign frame.

Still another significant aspect and feature of the present invention is the use of precision alignment mechanisms which are readily adjustable and alignable.

Still another significant aspect and feature of the present invention is the use of precision alignment mechanisms each having a housing, a contact block which is positionable within a cavity of the housing, a spring residing in the cavity of the housing which interacts with the contact block, and fasteners extending through the housing and the contact block for locking the position of the contact block.

Another significant aspect and feature of the present invention is the use of contact blocks which extend beyond the outer surfaces of a modular frame to contact other contact blocks which also extend beyond the outer surfaces of other similar modular frames.

Another significant aspect and feature of the present invention is the use of an alignment fixture having multiple alignment apparatuses in the form of jig towers which interface precisely with the contact blocks of the multiple precision alignment mechanisms.

Another significant aspect and feature of the present invention is a precision alignment system for modular frames of an electronic sign which system is easily and quickly used.

Having thus briefly described one or more embodiments of the present invention, and having mentioned some significant aspects and features of the present invention, it is the principal object of the present invention to provide a precision alignment system for modular frames for use with an electronic sign including precision alignment mechanisms and an alignment fixture.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein.

DETAILED DESCRIPTION OF THE PREFERRED EMBODIMENTS

Figure 1:
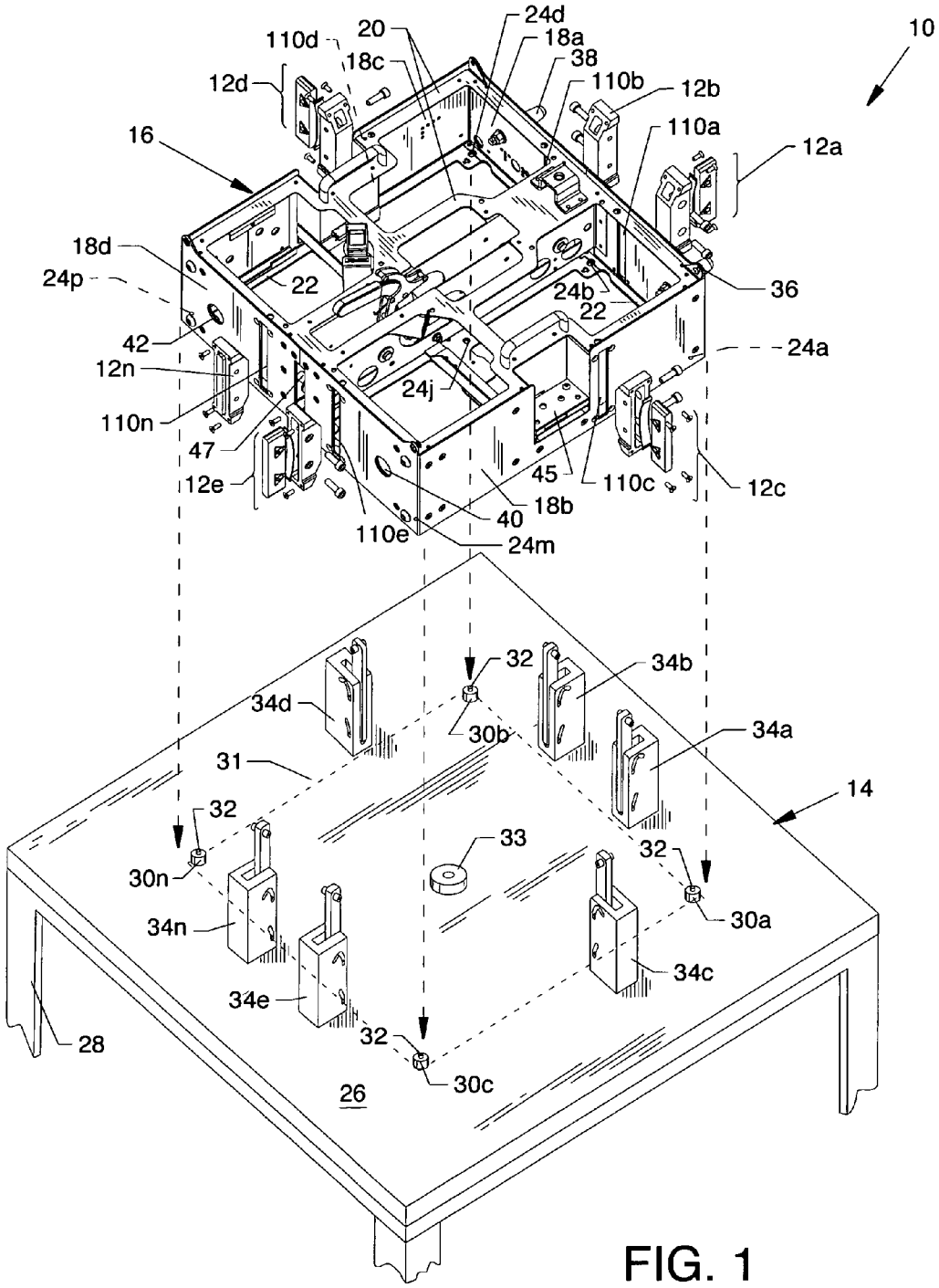
FIG. 1 is an isometric view of a precision alignment system for use with modular frames of an electronic sign which system comprises major components or assemblies including a plurality of precision alignment mechanisms and an alignment fixture, the present invention.
Figure 2:
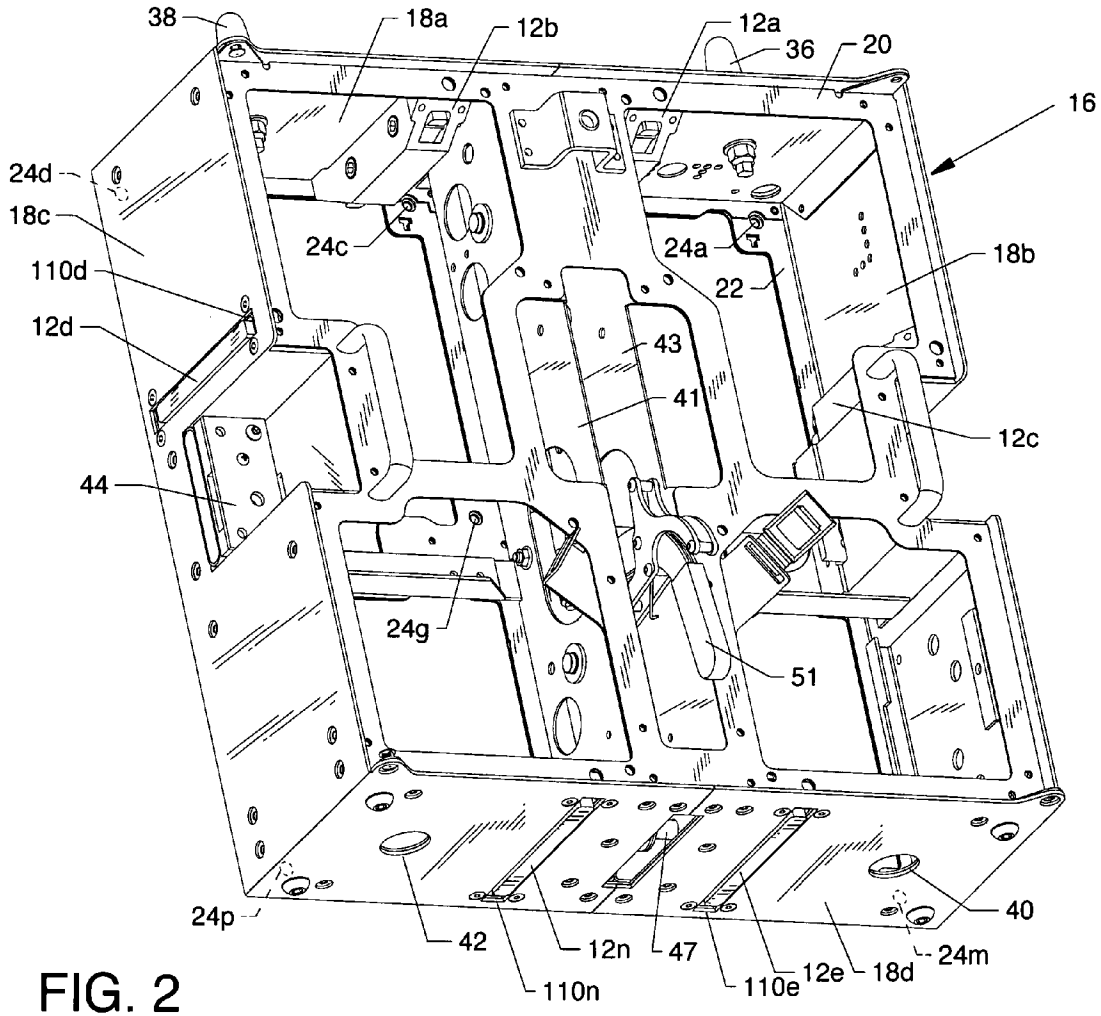
FIG. 2 is a rear view showing the location of the precision alignment mechanisms in the top panel, the side panels, and the bottom panel of a modular frame.

FIG. 1 is an isometric view of a precision alignment system 10 for use with modular frames of an electronic sign which system comprises major components or assemblies including a plurality of precision alignment mechanisms 12*a*-12*n* and an alignment fixture 14. For the purpose of illustration and demonstration, the precision alignment mechanisms 12*a*-12*n* are shown outside of the modular frame 16 but, when used, are mounted to the inside of the modular frame 16, as shown in FIG. 2 and in other figures. The precision alignment mechanisms 12*a*-12*n*, some of which are shown in exploded view, and the alignment fixture 14 are shown in use with a representative modular frame 16 for the purpose of demonstration and illustration of the present invention.

Figure 3:
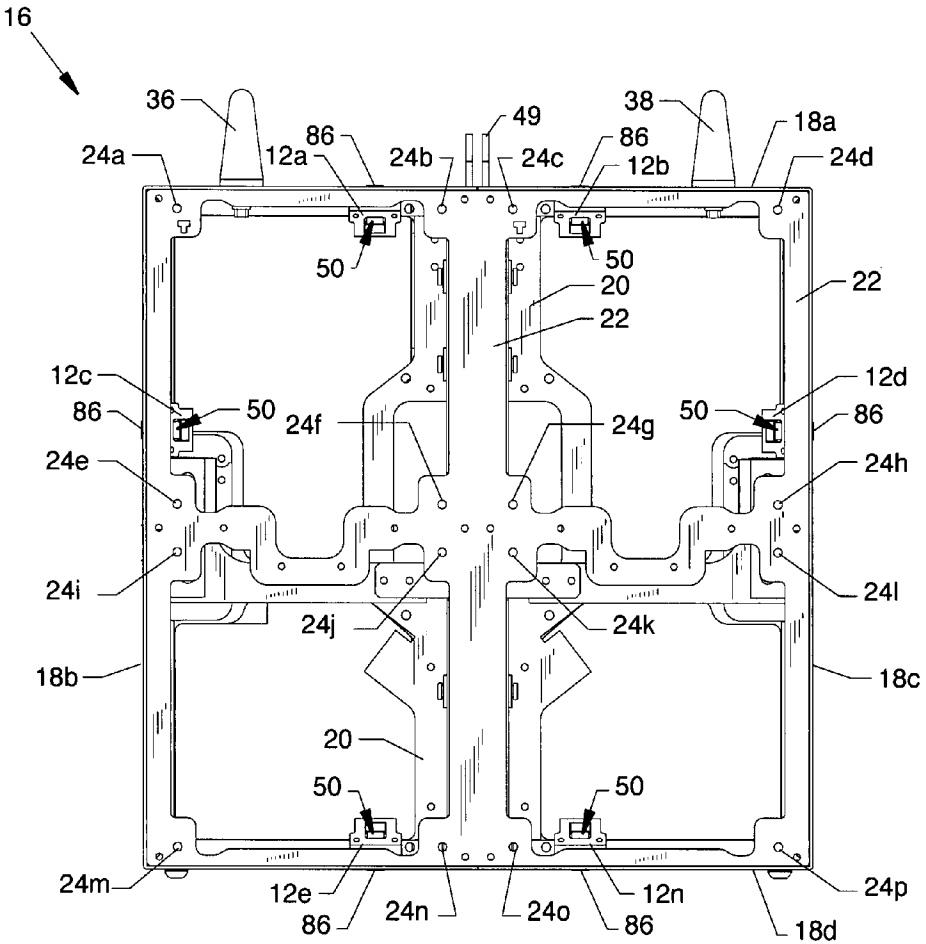
FIG. 3 is a front view of the modular frame having aligned contact blocks which extend through and beyond the rectangular holes in the top panel, the side panels, and the bottom panel of the modular frame.

The representative modular frame 16, which could be one of a number of modular frames which are positionable and which are consistent within the art, includes at least a top panel 18*a*, opposed side panels 18*b* and 18*c*, a bottom panel 18*d*, a rear panel 20 having multiple cutouts extending between the top panel 18*a*, side panels 18*b* and 18*c*, and the bottom panel 18*d*, and a front panel 22 which can be a double wall panel having multiple cutouts extending between the top panel 18*a*, side panels 18*b* and 18*c*, and the bottom panel 18*d*. A mounting hole 24*d*, one of a plurality of mounting holes 24*a*-24*p*, is shown in one corner of the front panel 22. The plurality of mounting holes 24*a*-24*p* is illustrated in FIG. 3 and which holes are located at the corners and at other locations of the front panel 22. The plurality of mounting holes 24*a*-24*p* is used for engagement of alignment pins extending rearwardly from a plurality of LED display modules. Mounting holes 24*a*, 24*d*, 24*m* and 24*p* are used during an alignment process to align the modular frame 16 to the pins 32 of standoffs 30*a*-30*n* in the alignment fixture, as described later in detail. Other components of the modular frame 16 can include other alignment structure (such as also shown in FIG. 2) such as vertical alignment posts 36 and 38 extending from the top panel 18*a* which posts align, but not in a precise fashion, to alignment holes 40 and 42 in the bottom panel 18*d* of another modular frame 16.

The alignment fixture 14, shown in FIG. 1, includes a sturdy base 26 and can include support legs 28. The plurality of precisely located standoffs 30*a*-30*n*, each having a round pin 32 extending from the top and along the centerline of the standoffs 30*a*-30*n*, is secured by suitable hardware to the upper side of the base 26. Preferably, the standoffs 30*a*-30*d* and pins 32 are centered near the apexes of an imaginary square 31 and register with the mounting holes 24*a*, 24*d*, 24*m* and 24*p* of the front panel 22 in order to align the edges of the top panel 18*a*, the side panels 18*b* and 18*c*, and the bottom panel 18*d* of the modular frame 16 with the imaginary square 31, but can be located in other configurations to register the with front panel mounting holes arranged in other geometric configurations in other modular frames. A support 33 is centrally located on the base 26. A plurality of precisely located alignment apparatuses in the form of jig towers 34*a*-34*n* is secured by suitable hardware to the upper side of the base 26 at locations uniformly spaced outside of, but in close proximity to, the imaginary square 31. Components of the jig towers 34*a*-34*n* interface precisely with components of the precision alignment mechanisms 12*a*-12*n*, the latter of which are mounted in the representative modular frame 16.

Figure 17:
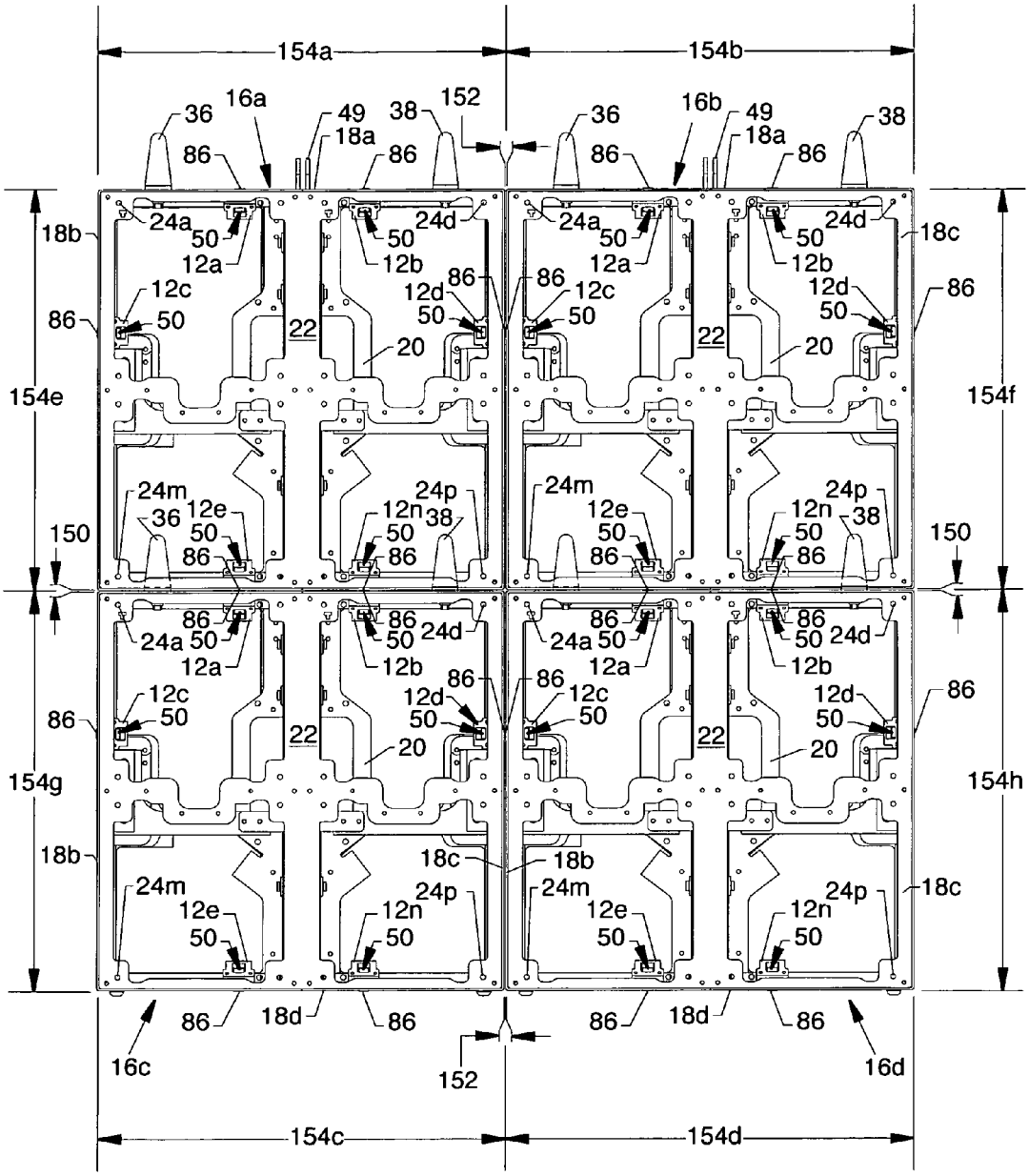

FIG. 2 is a rear view showing the use and location of the precision alignment mechanisms 12*a*-12*n* in the top panel 18*a*, the side panels 18*b* and 18*c*, and the bottom panel 18*d* of a modular frame 16. More precisely, the locations of the precision alignment mechanisms 12*a* and 12*b* are shown in the top panel 18*a*, the locations of the precision alignment mechanisms 12*c* and 12*d* are shown in the side panels 18*b* and 18*c*, respectively, and the locations of the precision alignment mechanisms 12*e* and 12*n* are shown in the bottom panel 18*d*. When the precision alignment mechanisms 12*a*-12*n* are used with multiple modular frames 16 in both vertically and horizontally aligned arrangements, precision alignment mechanisms 12*a*-12*n* of one modular frame align to other precision alignment mechanisms 12*a*-12*n* of adjacent modular frames 16. For purposes of example and demonstration, and with reference to the vertical stacking of modular frames 16, the precision alignment mechanisms 12*a* and 12*b* in the top panel 18*a* of a bottom modular frame 16 would align with the precision alignment mechanisms 12*e* and 12*n*, respectively, in the bottom panel 18*d* of a top modular frame 16. Such an alignment is shown in FIG. 17. In addition, other nonprecision alignment components of the frame 16, which are used for general alignment of successive vertically aligned frames 16, are shown including tapered alignment posts 36 and 38 extending from the top panel 18*a* and alignment holes 40 and 42 located in the bottom panel 18*d*. Transverse panels 41 and 43 are also shown extending between the top panel 18*a* and the bottom panel 18*d*. Other components are shown which can be used for securing to horizontally adjacent modular frames 16, including a latch/catch mechanism 44 located in close proximity to the side panel 18*c* for engagement with a latch/catch 45 mechanism (FIG. 1) located in close proximity to the side panel 18*b*. A latch/catch mechanism 47 is located near the bottom panel 18*d* and another latch/catch mechanism 49 is located near the top panel 18*a* (FIG. 3) and are operated by a handle 51 and associated mechanism to secure the bottom panel 18*d* of an upper modular frame 16 to the top panel 18*a* of a lower modular frame 16.

FIG. 3 is a front view of the modular frame 16 having aligned contact blocks 50 which extend through and beyond the rectangular holes 110*a*-110*n* (shown in FIGS. 1 and 2) in the top panel 18*a*, the side panels 18*b* and 18*c*, and the bottom panel 18*d* of the frame 16. This illustrative example showing the use of the present invention with the representative modular frame 16 illustrates a frame which, in this case, is a square frame 16. In the alternative, other shaped modular frames, such as rectangular shaped modular frames, could also be used with the present invention after the relocation of several components of the present invention.

Figure 4:
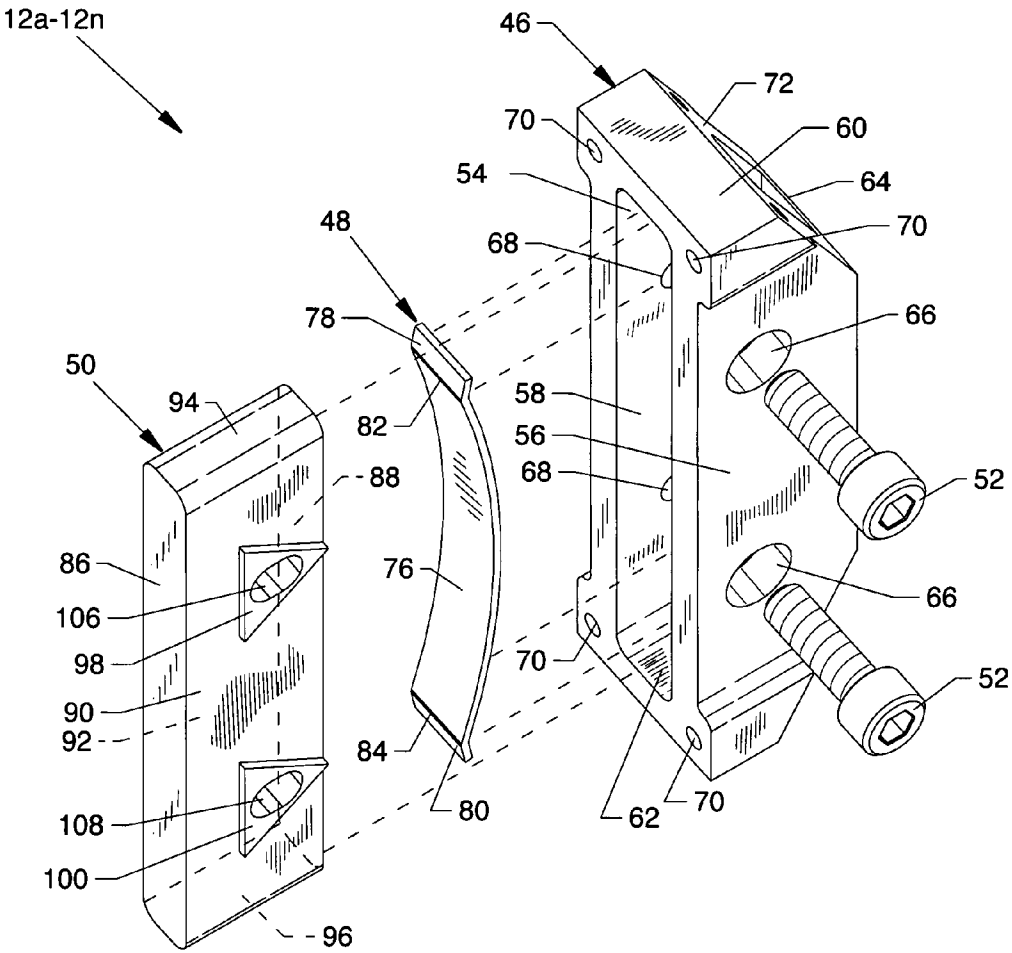
FIG. 4 and FIG. 5 are exploded isometric views showing opposing sides of components comprising one or more of the precision alignment mechanisms.
Figure 5:
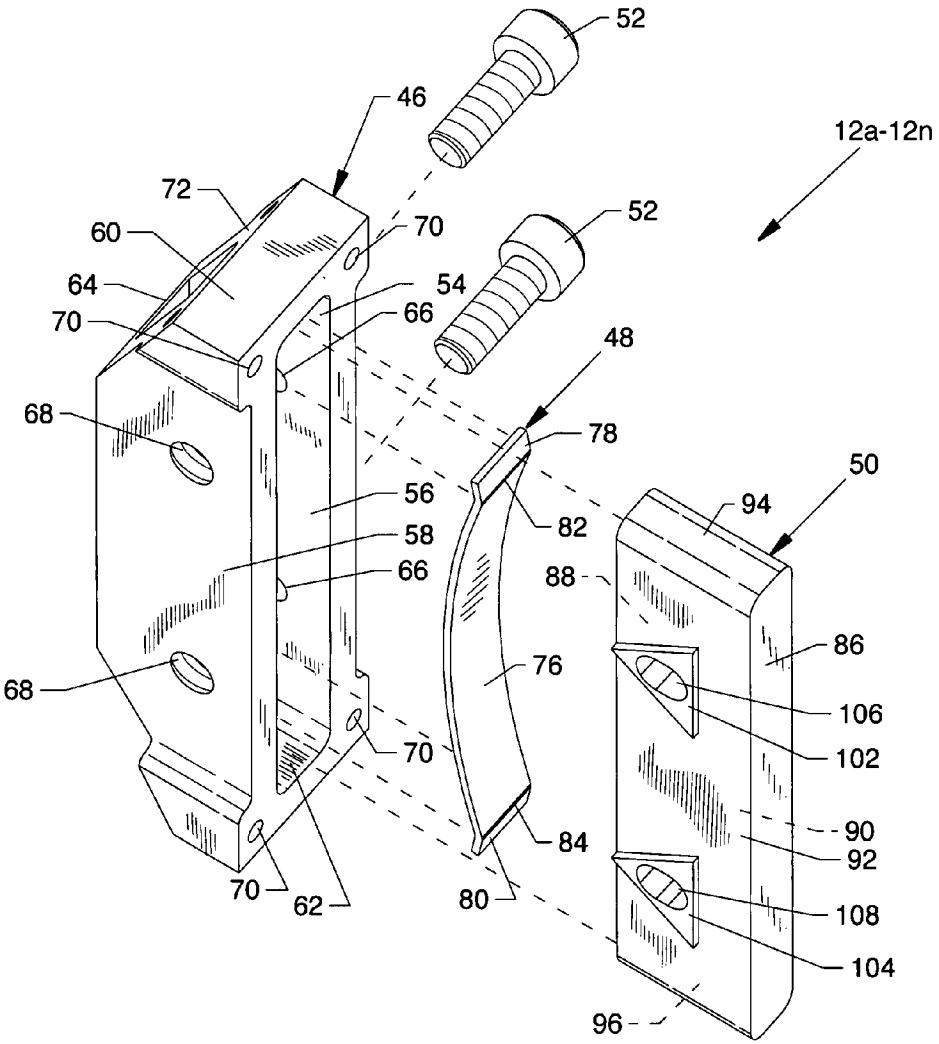
Figure 7:
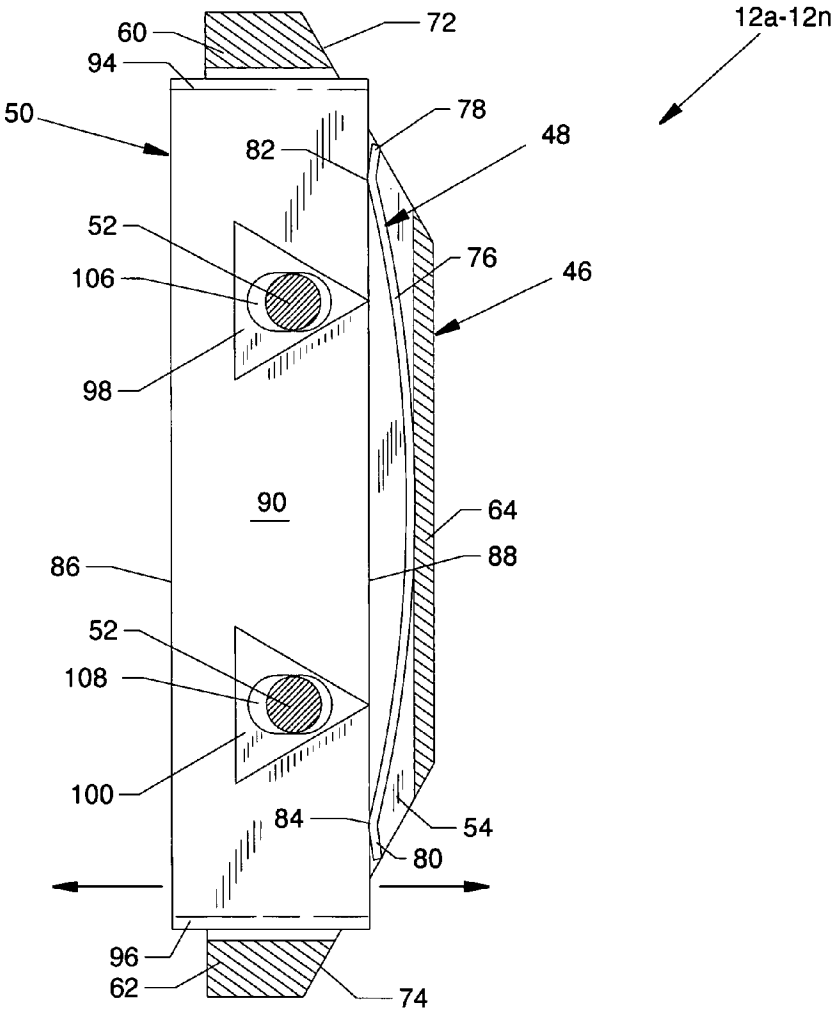
FIG. 7 is a cross section view of the housing and of the locking fasteners, but not of the contact block and the spring 48 of one or more of the precision alignment mechanisms along line 7-7 of FIG. 6.

FIG. 4 and FIG. 5 are exploded isometric views showing opposing sides of components comprising one or more of the precision alignment mechanisms 12*a*-12*n*. The individual components of the precision alignment mechanisms 12*a*-12*n* include a geometrically configured housing 46, a spring 48, a contact block 50, and locking fasteners 52, preferably in the form of a cap screw. The housing 46, preferably of aluminum or other material which is malleable and/or slightly flexible, includes a centrally located generally rectangular shaped cavity 54. Opposed side walls 56 and 58 connecting opposed end walls 60 and 62, a rear wall 64 connected to the side walls 56 and 58 and the end walls 60 and 62 form the cavity 54. Fastener body holes 66, including a recess for accommodation of a fastener head, extend through the sidewall 56. Threaded holes 68 in the sidewall 58 oppose the body holes 66 in the side wall 56 for accommodating the threads of the locking fasteners 52. Mounting holes 70 are located at the corners of the junctions of the sidewalls 56 and 58 with the end walls 60 and 62, respectively, of the housing 46. Bevels 72 and 74 at the ends of the housing 46 truncate the cavity 54 and are included to minimize interference with any other components which may be associated with the modular frames 16 of an LED display structure and to allow access into the cavity 54 in order to insert the spring 48 therein. The one-piece spring 48, which aligns within the cavity 54 of the housing 46 and against an inner contact surface 88 of the contact block 50, includes an arcuate section 76 having opposed planar ends 78 and 80 extending at an angle therefrom. The intersection of the planar end 78 with the arcuate section 76 forms a contact edge 82 and the intersection of the planar end 80 with the arcuate section 76 forms a contact edge 84. The contact edges 82 and 84 slidingly contact the inner contact surface 88 of the contact block 50. The one-piece contact block 50, which aligns within a greater portion of the cavity 54 in the housing 46, is substantially rectangular in shape having intersecting surfaces including an outer contact surface 86, an inner contact surface 88 opposing the outer contact surface 86, a side surface 90 and an opposing side surface 92, and an end surface 94 and an opposing end surface 96. Spacer pads 98 and 100 extend outwardly from the side surface 90 of the contact block 50 and spacer pads 102 and 104 extend outwardly from the side surface 92 of the contact block 50. The spacer pads 98-104 provide for spacing between the side surfaces 90 and 92 of the contact block 50 with the inwardly facing surfaces of the side walls 56 and 58 of the cavity 54 and for slideable or fixed surface contact between the inwardly facing surfaces of the side walls 56 and 58. An elongated hole 106 extends through the spacer pad 98, the main body of the contact block 50, and through the spacer pad 102. Another elongated hole 108 extends through the spacer pad 100, the main body of the contact block 50, and through the spacer pad 104. The locking fasteners 52 extend through the body holes 66, the spacer pads 98 and 100, elongated holes 106 and 108, the spacer pads 102 and 104, and into the threaded holes 68, respectively, whereby the contact block 50 can be slideably and adjustably captured within the cavity 54 of the housing 46, as shown in FIG. 7. The spring 48 is located between the inner contact surface 88 of the contact block 50 and the rear wall 64 of the housing 46 to maintain an outward loaded force on the contract block 50. The spring 48 can be loaded prior to or subsequent to placement of the contact block 50 within the cavity 54.

Figure 6:
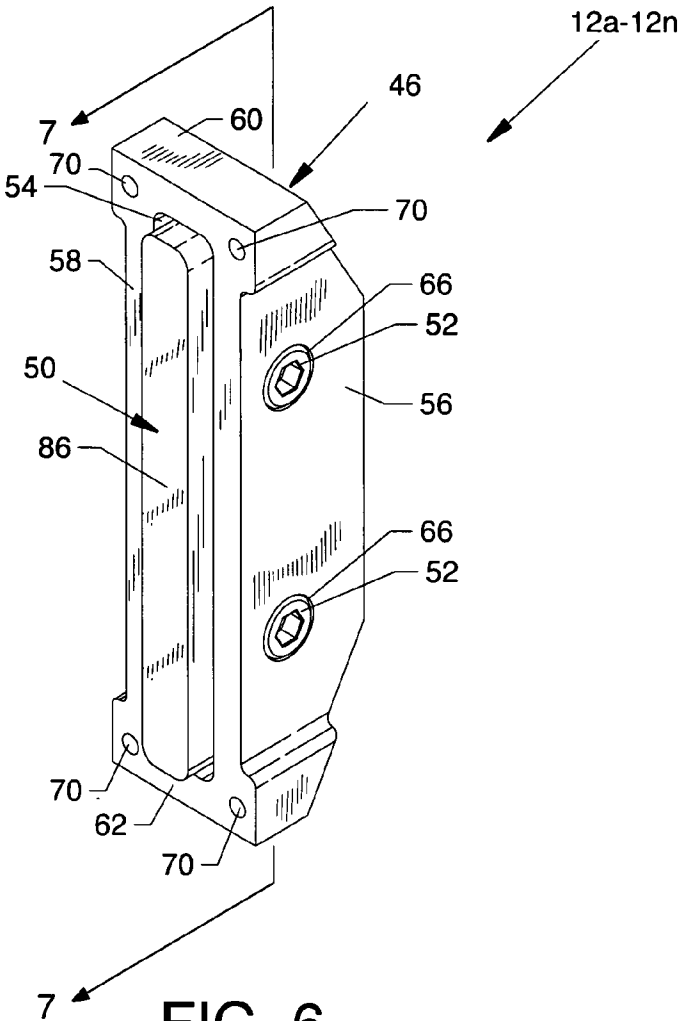
FIG. 6 is an isometric assembled view of one or more of the precision alignment mechanisms.

FIG. 6 is an isometric assembled view of one or more of the precision alignment mechanisms 12*a*-12*n*, and FIG. 7 is a cross section view of the housing 46 and of the locking fasteners 52, but not of the contact block 50 and the spring 48 of one or more of the precision alignment mechanisms 12*a*-12*n* along line 7-7 of FIG. 6. In each figure, a portion of the contact block 50, i.e., the outer contact surface 86, is shown adjustably extended and positionally fixed beyond the inner edges of the side walls 56 and 58 and the end walls 60 and 62 of the housing 46. FIG. 7 also shows the alignment of the spring 48 and the contact block 50 within the cavity 54 of the housing 46. The arcuate section 76 of the spring 48 intimately contacts the rear wall 64 of the cavity 54 of the housing 46. The contact edges 82 and 84 of the spring 48 intimately and slidingly contact the inner contact surface 88 of the contact block 50. The spring 48 always exerts and maintains pressure between the inner contact surface 88 of the contact block 50 and the rear wall 64 of the cavity 54, whereby the contact block 50 is spring loaded outwardly. During alignment, the contact blocks 50 are laterally positionable outwardly or inwardly against the spring force of the spring 48 within the cavities 54 of the housings 46 along a path defined and limited by the relationship of the locking fasteners 52 within the elongated holes 106 and 108 of the contact blocks 50 until secured by the locking fasteners 52. The precision alignment mechanisms 12*a*-12*n* are aligned by using the jig towers 34*a*-34*n* of the alignment fixture 14, as later described in detail. Any position of the spring loaded contact block 50 within the cavities 54 can be fixed by tightening the locking fasteners 52 once alignment is achieved. The locking fasteners 52 are tightened sufficiently to cause flexing of the side walls 56 and 58 inwardly to frictionally engage and fix the position of the spacer pads 98-104 of the contact block 50.

Figure 8:
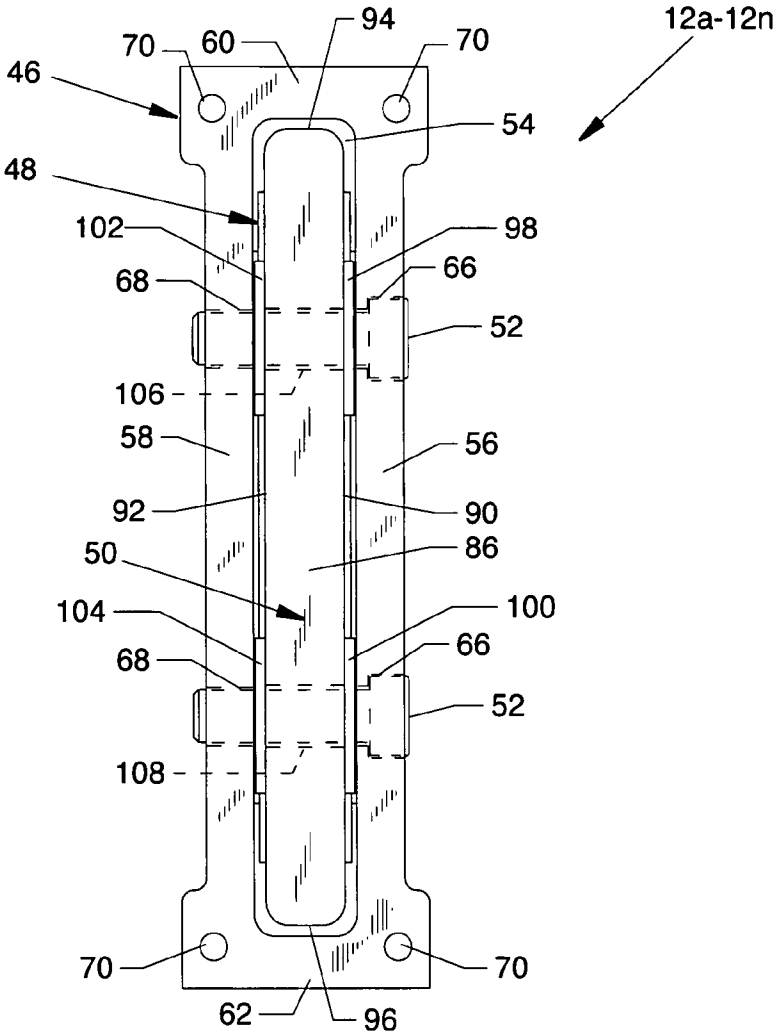
FIG. 8 is an end view of one or more of the assembled precision alignment mechanisms.

FIG. 8 is an end view of one or more of the assembled precision alignment mechanisms 12*a*-12*n* showing the alignment and clearance of the side surfaces 90 and 92 of the contact block 50 within the cavity 54 of the housing 46 as provided for by the use of the spacer pads 98-104. Engagement of the spacer pads 98-104 with the inner surfaces of the side walls 56 and 58 is also shown. Alignment of the locking fasteners 52 is also shown.

Figure 9:
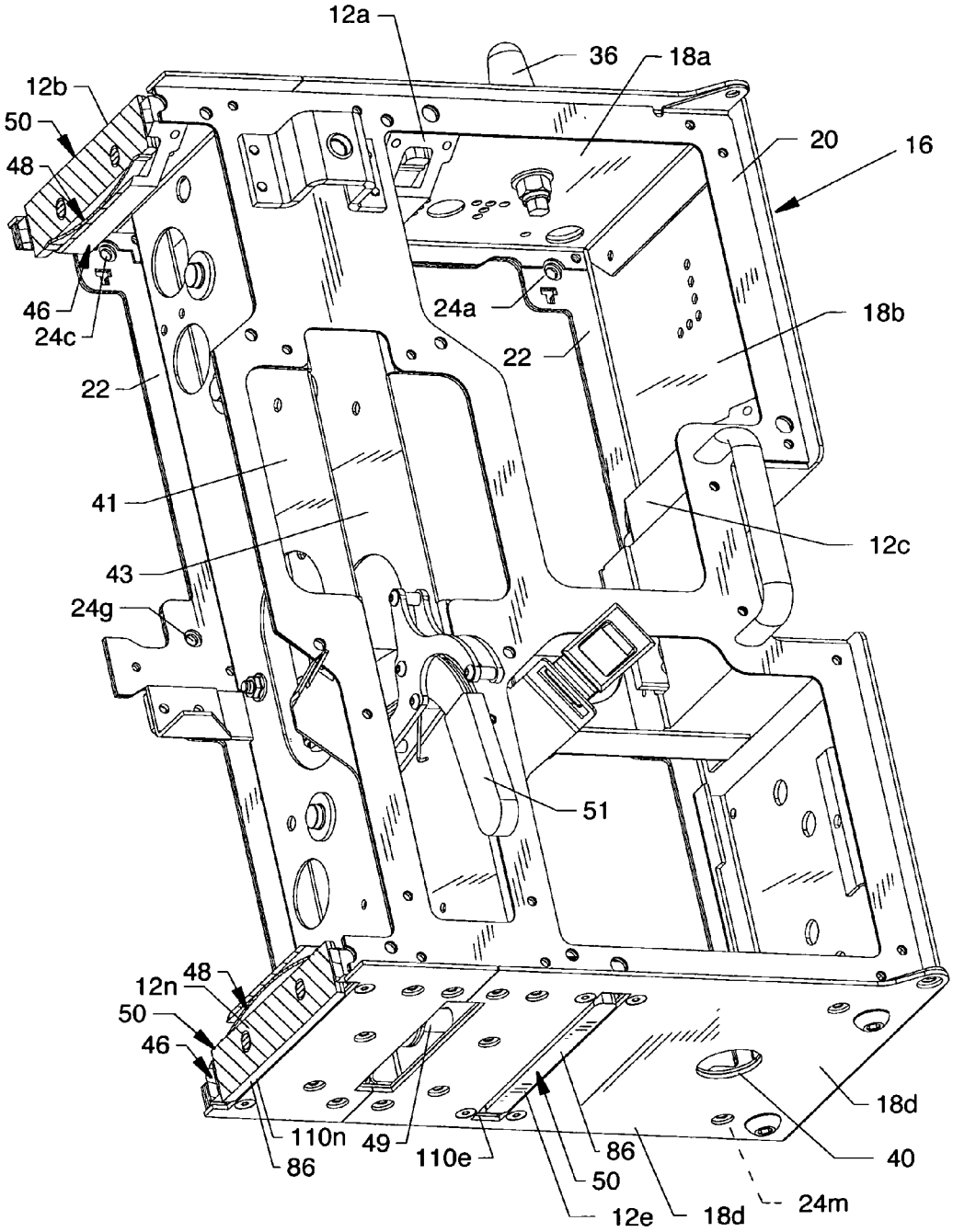
FIG. 9 is a cutaway partial cross section rear view showing the location of several precision alignment mechanisms.

FIG. 9 is a cutaway, partial cross section, rear view of a modular frame 16 showing the locations of several precision alignment mechanisms 12*a*-12*n*. Shown in particular are precision alignment mechanisms 12*a*, 12*b*, 12*c*, 12*e* and 12*n* secured to the top panel 18*a* and the bottom panel 18*d*, respectively, such as by the use of rivets, machine screws or other suitable fastening means which secure through the top panel 18*a*, the side panel 18*b*, and the bottom panel 18*d*, respectively, to engage the mounting holes 70 in the respective precision alignment mechanisms 12*a*-12*n*. Also shown are rectangular holes 110*e* and 110*n* of a plurality of rectangular holes 110*a*-110*n* (not all of which are shown) distributed along the top panel 18*a*, the side panels 18*b* and 18*c*, and the bottom panel 18*d* to which the precision alignment mechanisms 12*a*-12*n* align in order to allow for protrusion of the contact blocks 50 through and beyond the top panel 18*a*, the side panels 18*b* and 18*c*, and the bottom panel 18*d*.

Figure 10:
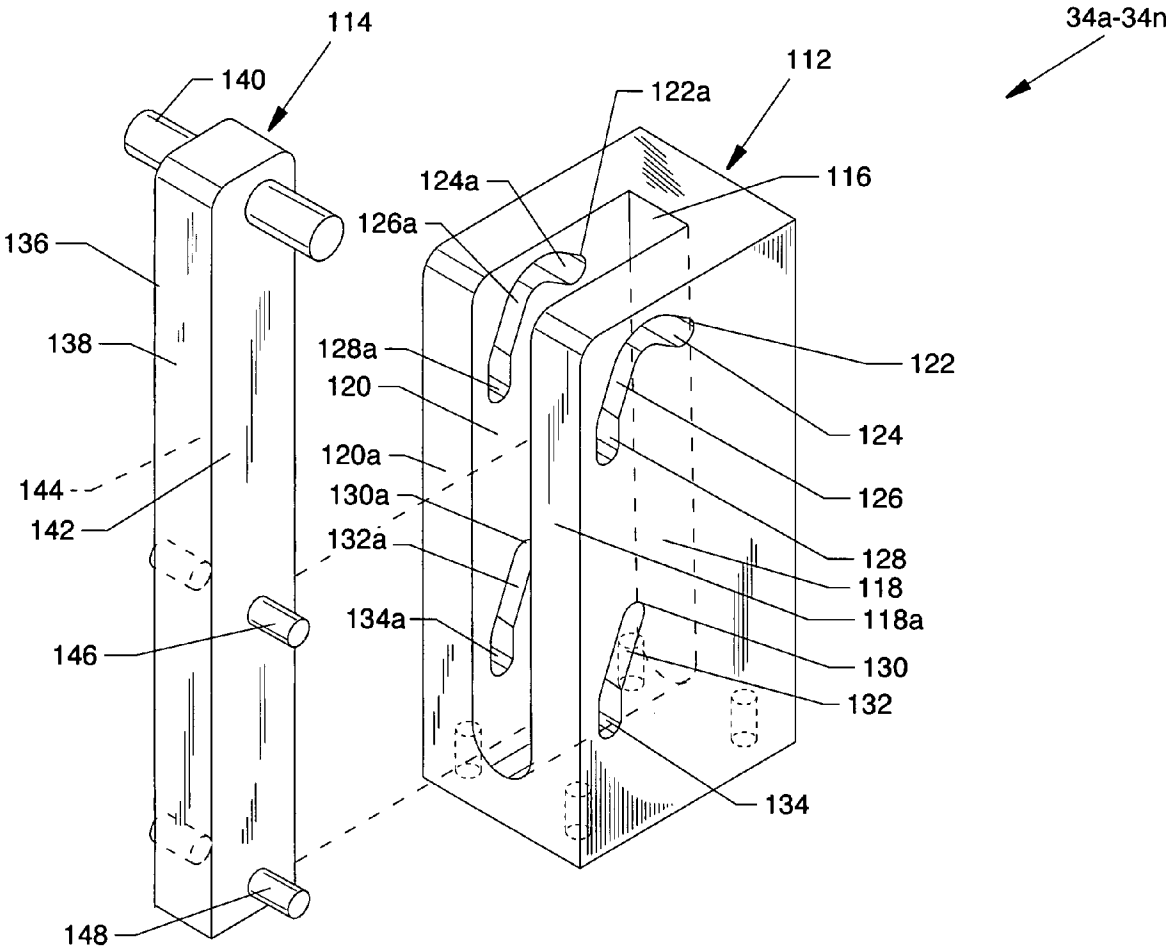
FIG. 10 is an exploded view of one or more of the plurality of jig towers.
Figure 11:
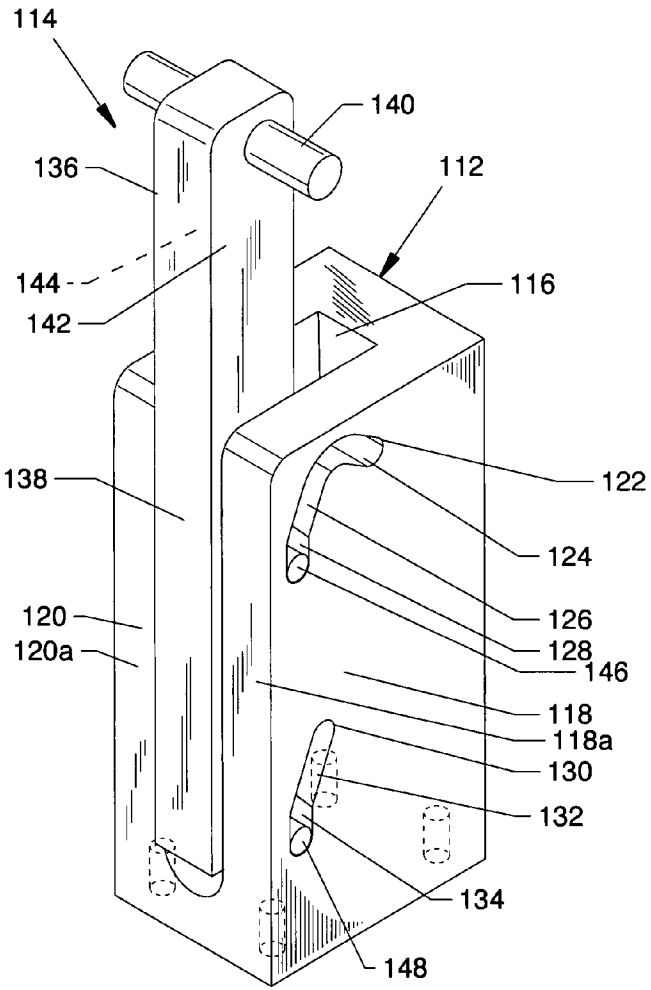
FIG. 11 is an assembled view of the components of FIG. 10.

FIG. 10 is an exploded view of one or more of the plurality of jig towers 34*a*-34*n* which are secured to the base 26 of the alignment fixture 14. The jig towers 34*a*-34*n* are generally comprised of two larger components including a geometrically configured housing 112 and a geometrically configured positionable alignment tool 114, the latter of which aligns within the housing 112 and is operated therewithin to provide for interaction with the contact blocks 50 of the precision alignment mechanisms 12*a*-12*n*, as described later in detail. FIG. 11 is an assembled view of the components of FIG. 10. The housing 112 includes a centrally located slot 116 which is open on two sides and extends along the major length of the housing 112. The slot 116 delineates panels 118 and 120 and extends along nearly the major height of the housing 112. The panel 118 includes a geometrically configured major guide track 122 extending therethrough and opening into the slot 116. The major guide track 122 is comprised of and includes connected and continuous sections having a disengage section 124, a transition section 126, and an engage and lock section 128. The opposing panel 120, which substantially mirrors and aligns distantly to the panel 118, is also comprised of and includes like features including a geometrically configured major guide track 122*a* extending therethrough and opening into the slot 116. The major guide track 122*a* is comprised of and includes connected and continuous sections having a disengage section 124*a*, a transition section 126*a*, and an engage and lock section 128*a*. The panel 118 also includes a geometrically configured minor guide track 130 extending therethrough and opening into the slot 116. The minor guide track 130 is comprised of and includes connected and continuous sections having a transition section 132 and an engage and lock section 134. The opposing panel 120, which substantially mirrors and aligns distantly to the panel 118, is also comprised of and includes like features including a geometrically configured minor guide track 130*a* extending therethrough and opening into the slot 116. The minor guide track 130*a* is comprised of and includes connected and continuous sections having a transition section 132*a* and an engage and lock section 134*a*. The engage and lock sections 128, 128*a*, 134 and 134*a* have a parallel relationship to the front panel surfaces 118*a* and 120*a*, respectively, of the panels 118 and 120. The transition sections 132 and 132*a* and the transition sections 126 and 126*a* have an angular relationship to the front panel surfaces 118*a* and 120*a*, respectively, of the panels 118 and 120. The disengage sections 124 and 124*a* have an angular relationship to the front panel surfaces 118*a* and 120*a*, respectively, of the panels 118 and 120. The major guide tracks 122 and 122*a*, the minor guide tracks 130 and 130*a*, and the associated sections involved therewith provide for controlling, positioning, maneuvering and locking the of the positionable alignment tools 114, as later described in detail. The positionable alignment tool 114 is directly associated with the housing 112 and is accommodated by the slot 116 of the housing 112 for positioning therein. The positionable alignment tool 114 includes a bar 136 having a contact surface 138 which is planar and which is located at one edge of the bar 136, a handle 140 in the form of a dowel or pin at one end of the bar 136 extends through the sides 142 and 144 at the upper region of the bar 136, a pin 146 passing through a mid-location of the bar 136 and extending beyond the sides 142 and 144 of the bar 136, and another pin 148 passing through the lower region of the bar 136 and extending beyond the sides 142 and 144 of the bar 136. The positionable alignment tool 114 is accommodated by the slot 116 of the housing 112, whereby the pin 146 aligns in the opposed major guide tracks 122 and 122*a* and the pin 148 aligns in the opposed minor guide tracks 130 and 130*a*.

Mode of Operation

Figure 12:
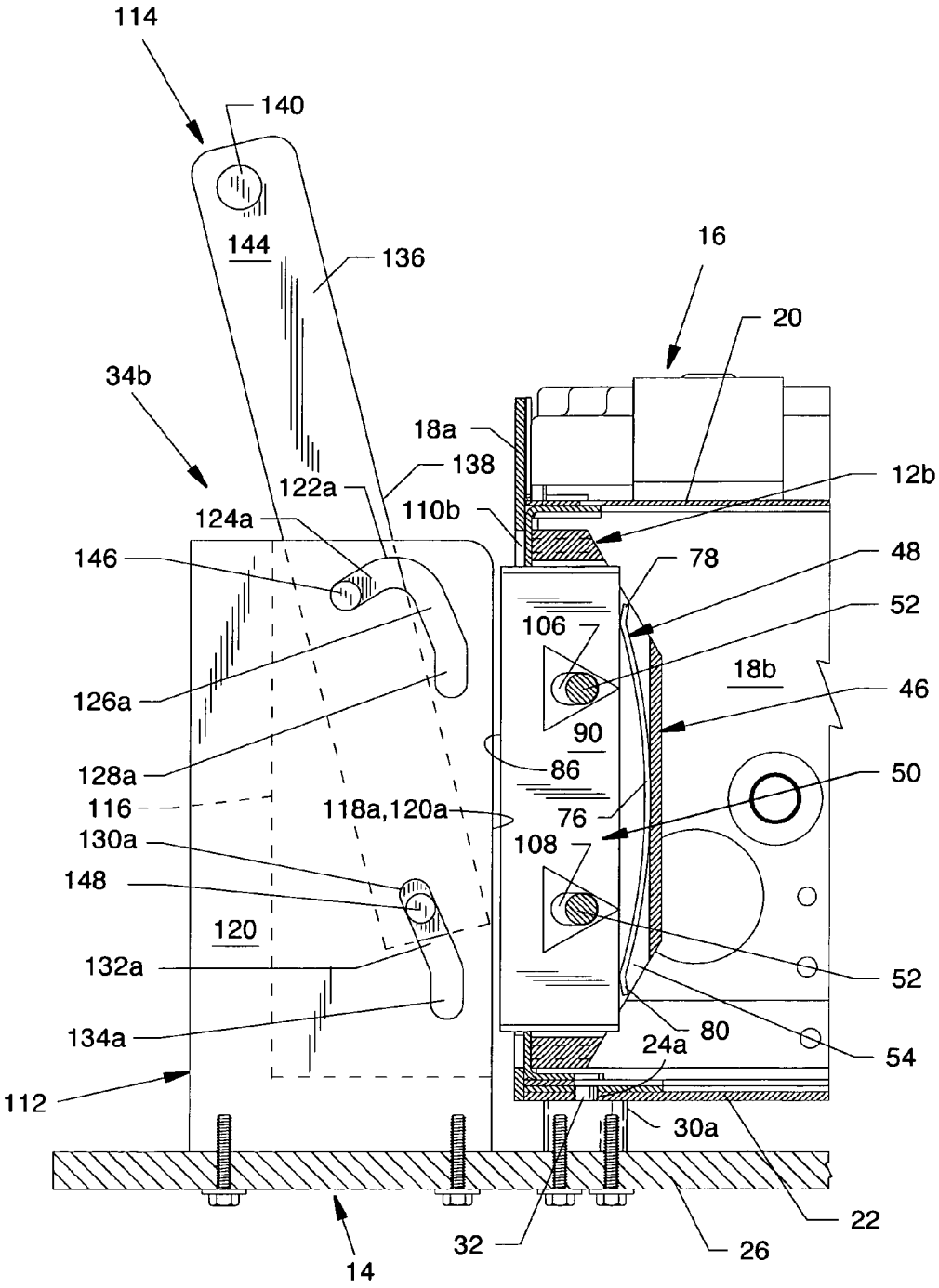
FIGS. 12, 13 and 14 Illustrate, in part, the mode of operation of the present invention.
Figure 13:
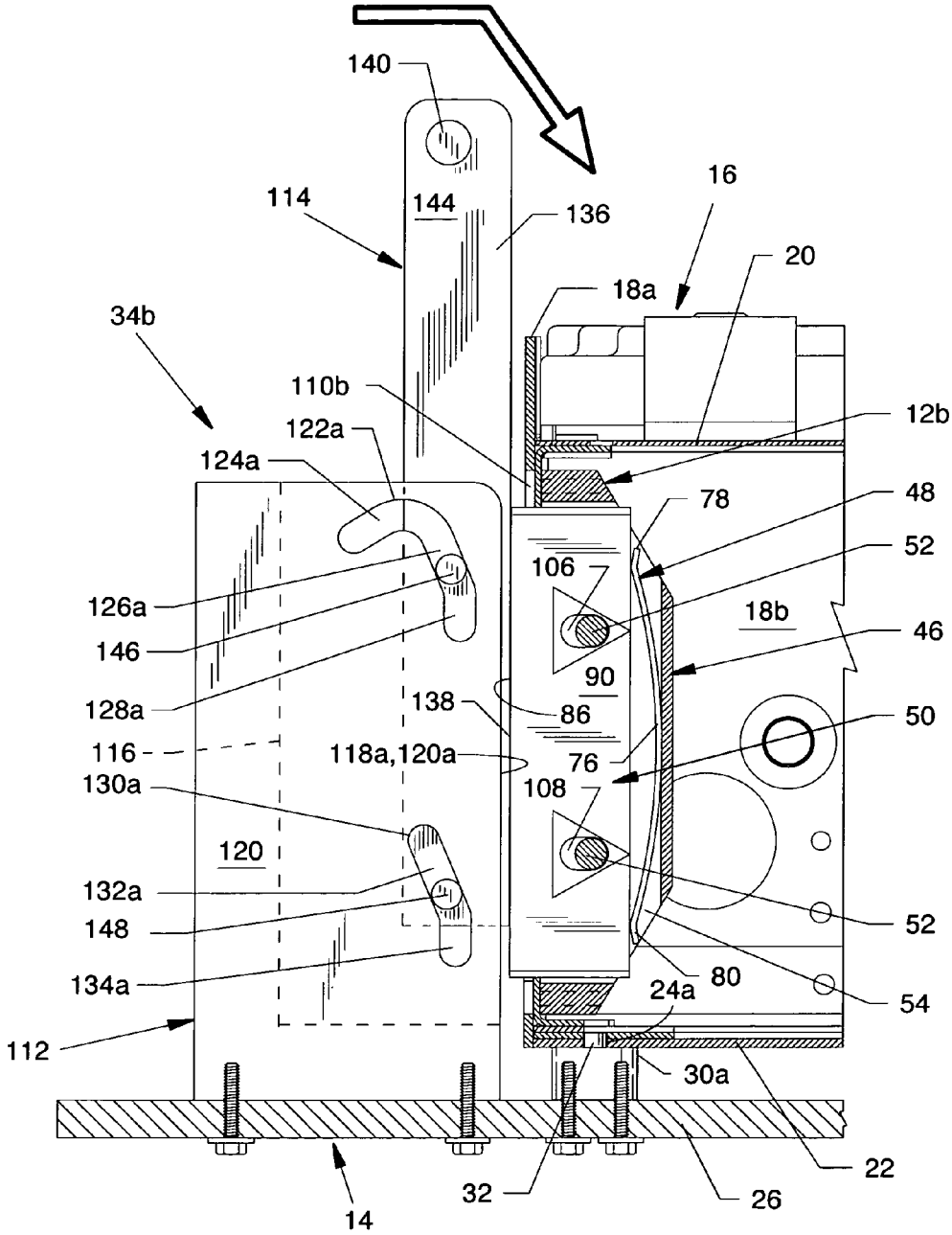
Figure 14:
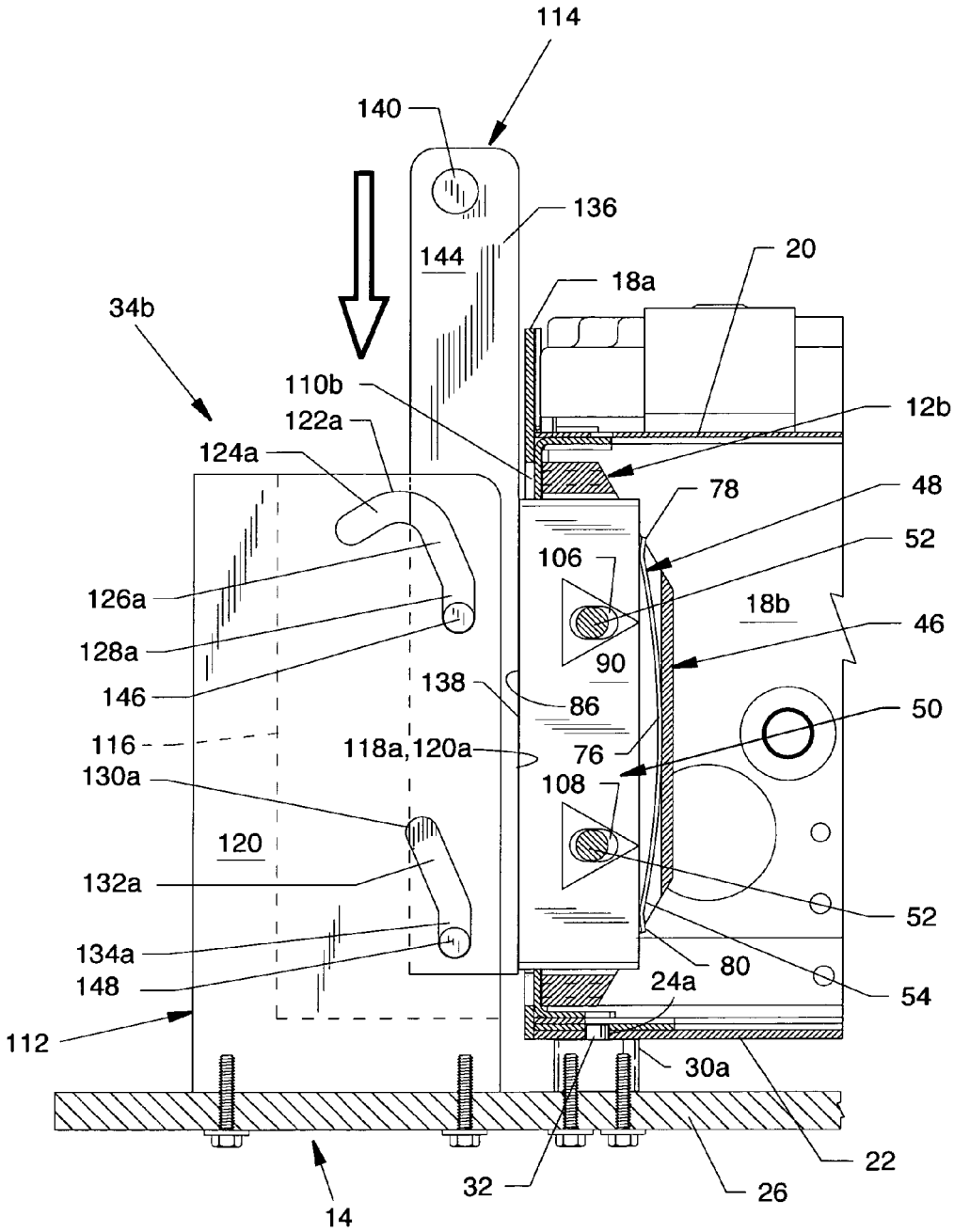

FIGS. 12, 13 and 14 illustrate, in part, the mode of operation of the present invention where one of the jig towers 34*b* is shown in alignment with one of the precision alignment mechanisms 12*b* mounted to the top panel 18*a* of a modular frame 16 of an electronic sign and the mechanical relationship involved therein. Operation of the jig towers 34*a*-34*n* and the precision alignment mechanisms 12*a*-12*n* are similar to the mode described herein and only a portion of the invention components and the relationship to part of the modular frame 16 are shown. The modular frame 16 with the precision alignment mechanisms 12*a*-12*n* secured thereto is first aligned face down to the alignment fixture 14. More precisely, the mounting holes 24*a* in the front panel 22 of the modular frame 16 aligns over and about the pin 32 of the standoff 30*a*, the mounting hole 24*d* aligns to the pin 32 of the standoff 30*b*, the mounting hole 24*m* aligns to the pin 32 of the standoff 30*c*, and the mounting hole 24*p* aligns to the pin 32 of the standoff 30*n*, and preferably, are held in place by gravity on the upper surface of each of the annular standoffs 30*a*-30*n*, respectively, whereby the modular frame 16 and the mounted precision alignment mechanisms 12*a*-12*n* are located and positionally fixed for interaction with the jig towers 34*a*-34*n* of the alignment fixture 14, as now described.

As shown in FIG. 12, the precision alignment mechanism 12*b* is in alignment with and in close proximity to the jig tower 34*b* in order that the contact surface 138 of the positionable alignment tool 114 can be positioned to come into intimate contact with the outer contact surface 86 of the contact block 50 in the precision alignment mechanism 12*b*. All of the positionable alignment tools 114 of all the jig towers 34*a*-34*n* are positioned in the disengaged position, as shown, in order that the modular frame 16 with the precision alignment mechanisms 12*a*-12*n* can be placed without interference on the pins 32 of the standoffs 30*a*-30*n*, as previously described. In the disengaged position, the pin 146 of the positionable alignment tool 114 is assisted by gravity and is aligned at rest in the innermost low end of the disengage sections 124 and 124*a* of the major guide track 122 and 122*a*, respectively, and the pin 148 of the positionable alignment tool 114 is aligned in the upper region of the transition sections 132 and 132*a* of the minor guide track 130 and 130*a*, respectively. Thus, the lower region of the bar 136 of the positionable alignment tool 114 remains within the confines of the slot 116 of the housing 112 and does not extend beyond the plane formed by the front panel surfaces 118*a* and 120*a* of the housing 112 in a position of non-interference with respect to the contact block 50, which is spring loaded in an outward direction from the precision alignment mechanism 12*b*.

As shown in FIG. 13, the handle 140 of the positionable alignment tool 114 is manually actuated simultaneously to the right and in a downward directed motion as partially assisted by gravity to cause the contact surface 138 of the bar 136 to extend beyond the plane formed by the front panel surfaces 118*a* and 120*a* of the housing 112 to intimately and uniformly contact the outer contact surface 86 of the contact block 50 in the precision adjustment mechanism 12*b*. During such transition actuation, the pin 146 of the positionable alignment tool 114 is moved from the disengaged position, shown in FIG. 12, and thence along the transition sections 126 and 126*a* of the major guide tracks 122 and 122*a*, respectively, and the pin 148 of the positionable alignment tool 114 is moved along the transition section 132 and 132*a* of the minor guide tracks 130 and 130*a*, respectively. Thus, the contact surface 138 at the lower region of the bar 136 on the positionable alignment tool 114 is positioned beyond the confines of the slot 116 of the housing 112 and extends beyond the plane formed by the front panel surfaces 118*a* and 120*a* of the housing 112 to intimately engage the outer contact surface 86 of the spring loaded block 50 located in the precision alignment mechanism 12*b*. Further, downward actuation of the handle 140 causes the pin 146 and the pin 148 to move along the transition sections 126 and 126*a*, respectively, and the transition sections 132 and 132, respectively, and then to progressively and slidingly urge the contact surface 138 along and with increasing pressure against the contact surface 86 of the contact block 50. During this action, the elongated holes 106 and 108 of the contact block 50 guide the contact block 50 along the central portion of the horizontally oriented locking fasteners 52 until reaching an aligned mid-position, such as shown in FIG. 14. Also during this action, the spring 48 offers resistance and is partially compressed and loaded and still maintains a spring force against the positionable alignment tool 114. Subsequently, the pins 146 and 148 enter the engage and lock sections 128 and 128*a* and the engage and lock sections 134 and 134*a*, respectively, as shown and described with reference to FIG. 14.

As shown in FIG. 14, the handle 140 of the positionable alignment tool 114 is fully moved in a downwardly directed motion, as partially assisted by gravity, in order to fully position the pin 146 into the engage and lock sections 128 and 128*a* and to fully position the pin 148 into the engage and lock sections 134 and 134*a*. Upon entry of the pins 146 and 148 into the engage and lock sections 128 and 128*a* and into the engage and lock sections 134 and 134*a*, respectively, tension by the spring 54 against the contact block 50 is established at a constant force and is maintained as the positionable alignment tool 114 is urged downwardly along therein and into the lowermost position of the engage and lock sections 128 and 128*a* and 134 and 134*a*. The engage and lock section 128 and the engage and lock section 134 in the panel 118 are each parallel to and at a uniform predetermined distance from the front panel surface 118*a* of the housing 112 and correspondingly and in an opposed mirror-like image, the engage and lock section 128*a* and the engage and lock section 134*a* in the panel 120 are each parallel to and at the same uniform predetermined distance from the front panel surface 120*a* of the housing 112. For example, the engage and lock sections 128 and 128*a* and 134 and 134*a* are similarly sized, configured, oriented and arranged in order to provide for motion of the pins 146 and 148 and thus of the positionable alignment tool 114 uniformly with respect to a plane associated along corresponding features of the engage and lock sections 128 and 128*a* and 134 and 134*a*. Furthermore, the vertical axis of each of the engage and lock sections 128, 128*a*, 134 and 134*a* is in perpendicular alignment to the base 26 of the alignment fixture 14 and each of the bases 26 is aligned at a common distance from a reference, such as, but not limited to, the imaginary square 31 shown in FIG. 1. When the positionable alignment tools 114 are positioned along the engage and lock sections 128, 128*a*, 134 and 134*a*, the contact surfaces 138 of the positionable alignment tools 114 are also in perpendicular alignment to the base 26 which is common to each of the precision alignment mechanisms 12*a*-12*n*. The alignment relationship of the contact faces 86 of the contact blocks 50 against the perpendicularly oriented contact surfaces 138 of the positionable alignment tools 114 provides a plurality of contact surfaces 138 extending slightly beyond the surfaces of the top panel 18, the side panels 18*a*-18*b*, and the bottom panel 18*d*, respectively, and requires only the locking of the contact blocks 50 in jigged vertically aligned orientation by the tightening of the locking fasteners 52 to secure the contact blocks 50 within the cavities 54 of each of the housings 46 located in the precision alignment mechanisms 12*a*-12*n*. Tightening of the locking fasteners 52 slightly deforms the side walls 56 and 58 such that the inner surfaces of the side walls 56 and 58 are drawn against the outwardly facing surfaces of the closely spaced spacer pads 98-104, respectively, to frictionally engage and to positionally fix the position of the perpendicularly aligned contact blocks 50 within the cavities 54.

Figure 15:
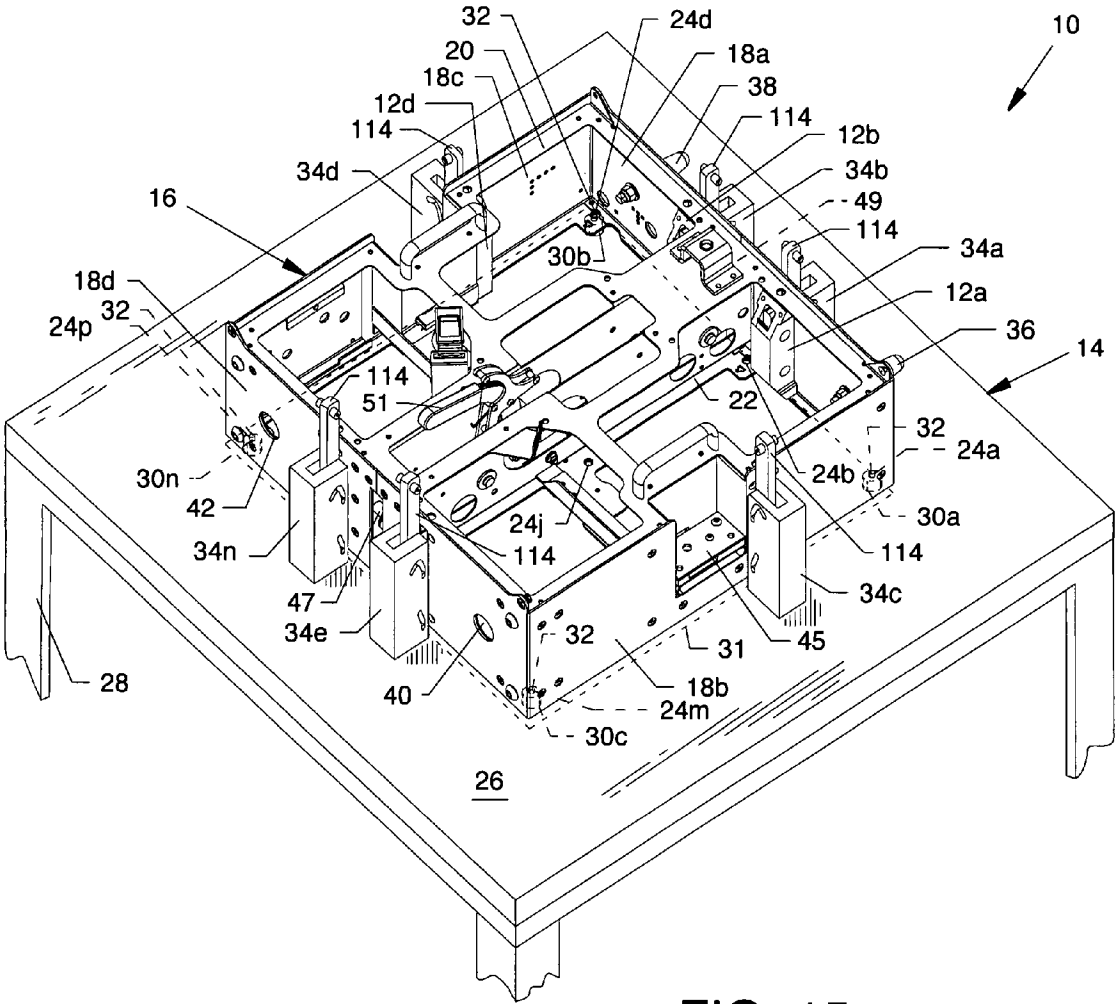
FIG. 15 illustrates the use of the precision alignment system with a modular frame where the jig towers contact the precision alignment mechanisms mounted in the modular frame.

FIG. 15 illustrates the use of the precision alignment system 10 with a modular frame 16 where components of the jig towers 34*a*-34*n* contact the precision alignment mechanisms 12*a*-12*n* mounted in the modular frame 16. The positionable alignment tools 114 are shown in the engage and lock mode. Subsequent to tightening of the locking fasteners 52 to fix the vertical alignment of the contact blocks 50 in each of the precision alignment mechanisms 12*a*-12*n*, the positionable alignment tools 114 can be retractingly repositioned from the engage and lock sections 128 and 128*a* of the jig towers 34*a*-34*n* to the disengage sections 124 and 124*a* of the jig towers 34*a*-34*n*, thereby discontinuing intimate contact of the contact surfaces 138 of the positionable alignment tools 114 with the outer contact surface 86 of the contact blocks 50 in order to remove the modular frame 16 from the alignment fixture 14. The modular frame 16, having the aligned and positionally fixed contact blocks 50, can then be used with other similarly constructed and similarly aligned and positionally fixed contact blocks 50, as shown in FIGS. 16 and 17.

Figure 16:
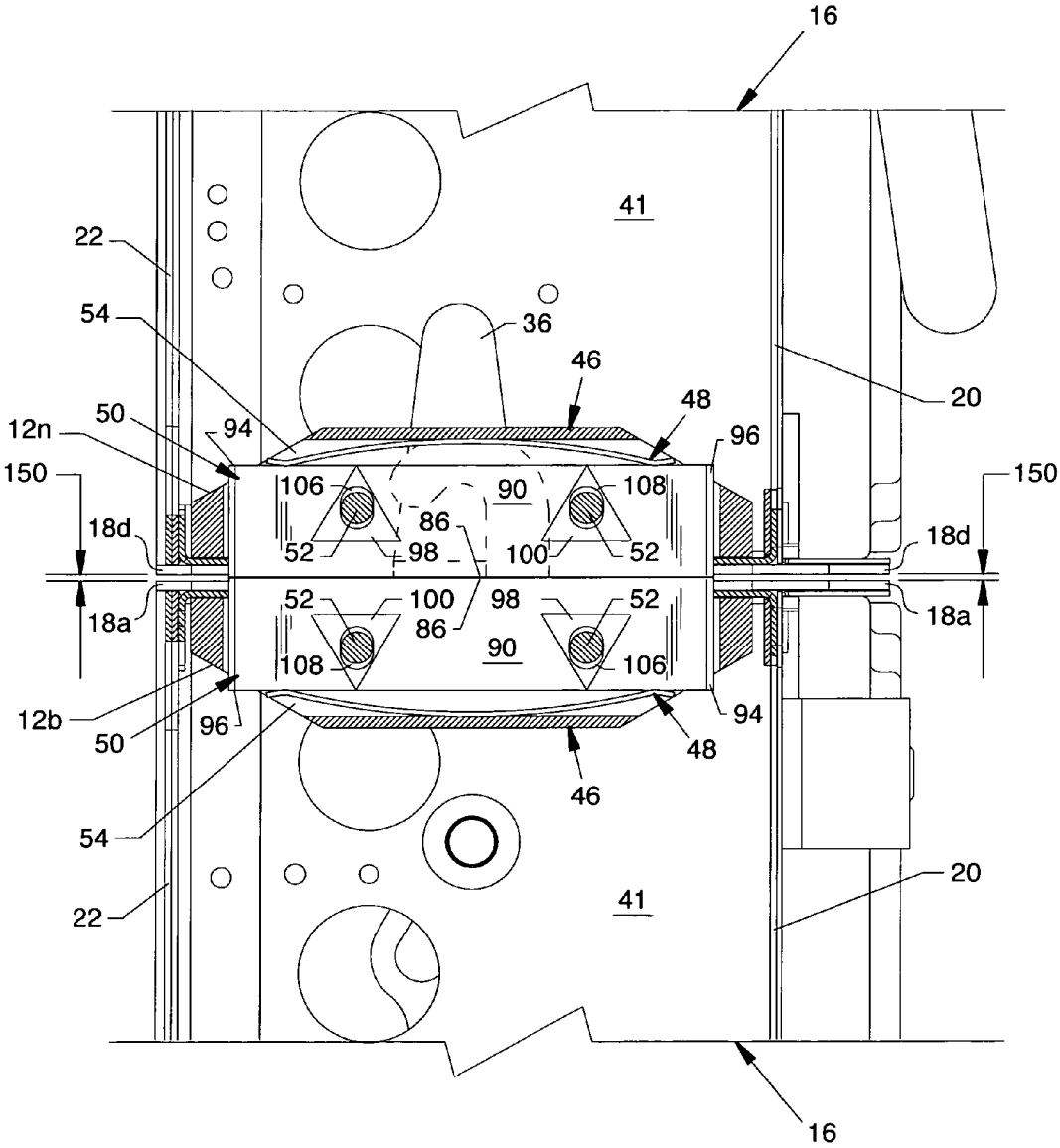
FIG. 16 shows an example showing the mating of stacked upper and lower modular frames using the precision alignment mechanism of an upper modular frame and the precision alignment mechanism of a lower modular frame; and, FIG. 17 is a front view of an assembled example showing the mating of multiple horizontally and vertically adjacent modular frames using the precision alignment mechanisms of the present invention.

FIG. 16 shows an example mating of stacked upper and lower modular frames 16 using the precision alignment mechanism 12*n* of an upper frame 16 and the precision alignment mechanism 12*b* of a lower frame 16 subsequent to the alignment by use of the respective jig towers 34*a*-34*n* and associated components thereof. The outer contact surface 86 of the contact block 50 (precision alignment mechanism 12*n*) used in the upper modular frame 16 is shown in intimate contact with the outer contact surface 86 of the contact block 50 (precision alignment mechanism 12*b*) used in the lower modular frame 16. A space 150 is shown generally located and extending between the bottom panel 18*d* and the top panel 18*a* of the upper and lower modular frames 16, respectively. The space 150 can be constant or can be unequal or irregular within the limits of formation. The horizontally aligned space 150 extends along the depth and width of the modular frames 16 in accordance with acceptable nonprecision manufacturing tolerance therebetween as the modular frames 16 are not fashioned according to precision standards, but are fashioned within nonprecision tolerances suitable for general alignment without mutual interference. A vertically aligned space 152 (FIG. 17) corresponding to the horizontally aligned space 150 is generally located between the side panel 18*b* and the side panel 18*c* of horizontally adjacent modular frames 16, respectively. The vertically aligned space 152 can be constant or can be unequal or irregular. The vertically aligned space 152 extends along the depth and height of the modular frames 16. The precision alignment of multiple modular frames 16 is provided by the mating of the precisely aligned and oriented multiple contact blocks 50 of the invention. The multiple contact blocks 50 only are used for the precise and close tolerance mating between adjacent horizontally and vertically situated and aligned modular frames 16 and none of the top panels 18*a*, side panels 18*b* and 18*c* or bottom panels 18*d* are in contact with each other, but are aligned across the spaces 150 and 152.

FIG. 17 is a front view showing the mating of multiple, horizontally and vertically, adjacently stacked modular frames 16, herein identified as modular frames 16*a*, 16*b*, 16*c* and 16*d*, using the precision alignment mechanisms 12*a*-12*n* of the present invention subsequent to the alignment by using the respective jig towers 34*a*-34*n* and associated components thereof. The previously described spaces 150 and 152 are shown which are generally horizontally or vertically oriented, respectively, and are not contactingly involved with the precision mating of the multiple, horizontally and vertically, adjacently positioned modular frames 16. Common outer precise dimensions, as measured with reference to the outer contact surfaces 86 along the height and length of the modular frames 16, are beneficial to the alignment of modular frames 16*a*-16*d*. For example, with respect to modular frame 16*a*, a common dimension 154*a*, as measured between the outer contact surface 86 of the precision alignment mechanism 12*c* and the contact surface 86 of the precision alignment mechanism 12*d*, is the same as the corresponding dimensions 154*b*, 154*c* and 154*d* with respect to modular frames 16*b*, 16*c* and 16*d*. Provided that the modular frames 16*a*-16*d* are configured as perfect squares, the same and common dimension 154*e*, as measured between the outer contact surface 86 of the precision alignment mechanism 12*a* and the contact surface 86 of the precision alignment mechanism 12*e*, is the same as the dimensions 154*f*, 154*g* and 154*h* with respect to modular frames 16*b*, 16*c* and 16*d*, respectively. Then, in this example, the dimensions 154*a*, 154*b*, 154*c* and 154*d* are the same as dimensions 154*e*, 154*f*, 154*g* and 154*h* and the alignment of modular frames 16*a*-16*d* results in a combined frame structure also being perfectly square. The use of rectangular shaped modular frames would, of course, have other dimensional qualities and aspects.

Various modifications can be made to the present invention without departing from the apparent scope thereof.

PRECISION ALIGNMENT SYSTEM

| PARTS LIST | |
|---|---|
| 10 | precision alignment system |
| 12a-n | precision alignment mechanism |
| 14 | alignment fixture |
| 16 | modular frame |
| 16a-d | modular frames |
| 18a | top panel |
| 18b-c | side panels |
| 18d | bottom panel |
| 20 | rear panel |
| 22 | front panel |
| 24a-p | mounting holes |
| 26 | base |
| 28 | legs |
| 30a-n | standoffs |
| 31 | imaginary square |
| 32 | pin |
| 33 | center support |
| 34a-n | jig tower |
| 36 | alignment post |
| 38 | alignment post |
| 40 | alignment hole |
| 41 | transverse panel |
| 42 | alignment hole |
| 43 | transverse panel |
| 44 | latch/catch mechanism |

-continued

| PARTS LIST | |
|---|---|
| 45 | latch/catch mechanism |
| 46 | housing |
| 47 | latch/catch mechanism |
| 48 | spring |
| 49 | latch/catch mechanism |
| 50 | contact block |
| 51 | handle |
| 52 | locking fasteners |
| 54 | cavity |
| 56 | side wall |
| 58 | side wall |
| 60 | end wall |
| 62 | end wall |
| 64 | rear wall |
| 66 | body holes |
| 68 | threaded holes |
| 70 | mounting holes |
| 72 | bevel |
| 74 | bevel |
| 76 | arcuate section |
| 78 | planar end |
| 80 | planar end |
| 82 | contact edge |
| 84 | contact edge |
| 86 | outer contact surface |
| 88 | inner contact surface |
| 90 | side surface |
| 92 | side surface |
| 94 | end surface |
| 96 | end surface |
| 98 | spacer pad |
| 100 | spacer pad |
| 102 | spacer pad |
| 104 | spacer pad |
| 106 | elongated hole |
| 108 | elongated hole |
| 110a-n | rectangular holes |
| 112 | housing |
| 114 | positionable alignment tool |
| 116 | slot |
| 118 | panel |
| 118a | front panel surface |
| 120 | panel |
| 120a | front panel surface |
| 122 | major guide track |
| 122a | major guide track |
| 124 | disengage section |
| 124a | disengage section |
| 126 | transition section |
| 126a | transition section |
| 128 | engage and lock section |
| 128a | engage and lock section |
| 130 | minor guide track |
| 130a | minor guide track |
| 132 | transition section |
| 132a | transition section |
| 134 | engage and lock section |
| 134a | engage and lock section |
| 136 | bar |
| 138 | contact surface |
| 140 | handle |
| 142 | side |
| 144 | side |
| 146 | pin |
| 148 | pin |
| 150 | space |
| 152 | space |
| 154a-d | dimensions |

It is claimed:

1. A modular frame for an electronic sign comprising:

an elongated top wall panel;

an elongated bottom wall panel parallel to and spaced from said top wall panel;

an elongated right side wall panel attached to said top and bottom wall panels:

an elongated left side wall panel attached to said top and bottom wall panels and spaced opposite to and parallel to said right side wall panel;

said elongated top, bottom, right side and left side wall panels forming a square or rectangular configuration;

a plurality of precision alignment mechanisms attached to said elongated top wall panel, said elongated bottom wall panel, said elongated right side wall panel and said elongated left side wall panel;

each of said precision alignment mechanisms including an elongated contact block with a front elongated contact surface, said front elongated contact surface extending a predetermined precise distance externally beyond each of said elongated top, bottom and left and right side wall panels; and each of said precision alignment mechanisms including an elongated housing attached perpendicularly and vertically to said internal side of each of said wall panels, each of said elongated housings having an elongated cavity therein for receiving and retaining said elongated contact block therein.

2. The modular frame of claim 1, wherein said elongated housing has a rear wall, a pair of oppositely spaced side walls, and a top and bottom end wall defining said elongated cavity therein, each of said precision alignment mechanisms further includes an arcuately shaped spring positioned within said elongated cavity between said elongated contact block and an internal side of said rear wall of said elongated housing, said elongated contact block having a pair of spaced holes therethrough along its vertical length, and a locking fastener extending through each of said oppositely spaced side walls of said elongated housing and through each of said holes in said elongated contact block.

3. The modular frame of claim 2, wherein said elongated housing further includes a pair of apertured spacer pads positioned within said elongated cavity around each of said locking fasteners and between opposite sides of said contact block and said oppositely spaced side walls of said elongated housing.

4. The modular frame of claim 3, wherein each of said holes in said contact block is elongated in a horizontal direction of said contact block.

5. The modular frame of claim 4, wherein there are two precision alignment mechanisms, spaced from each other and vertically attached to an inner surface of said elongated top wall panel and to an inner surface of said elongated bottom wall panel and a precision alignment mechanism vertically attached to an inner surface of each of said left and right side wall panels.

6. The modular frame of claim 5, wherein said modular frame further includes a rear panel attached to said top, bottom, and side panels, and a front panel parallely spaced from said rear panel and attached to said top, bottom, and side panels, each of said front panel and said rear panel being perpendicular to said top, bottom, and side walls, said front each of said four corners.

7. An alignment fixture for a modular frame comprising:

a flat base having a square or rectangular configuration, said flat base having a top surface and a bottom surface;

a plurality of vertically extending jig towers fixed to said top surface of said flat base and spaced from each other in a predetermined pattern around an imaginary square or rectangular perimeter line on said top surface of said flat base;

a first pair of said jig towers positioned adjacent one outer side of said imaginary line and spaced from each other;

a second pair of said jig towers positioned adjacent an opposite outer side of said imaginary line and spaced from each other;

a first single jig tower positioned adjacent an outer side of said imaginary line between said one and opposite sides of said imaginary line;

a second single jig tower positioned adjacent an outer side of said imaginary line opposite said first jig tower, each of said jig towers including a housing with a centrally located elongated slot therein, said housing having a pair of spaced front elongated surfaces adjacent said elongated slot and facing towards said imaginary line;

an elongated bar having a front elongated contact surface, said elongated bar being moveable within said elongated slot of said housing; and, said elongated bar being moveable towards said imaginary line such that when said elongated bar is fully moved within said elongated slot towards said imaginary line said elongated bar will have said front elongated contact surface extending a predetermined precise distance beyond said front elongated surfaces of said housing and parallel thereto.

8. An alignment fixture of claim 7, wherein said alignment fixture further includes a standoff fixed to said flat base within each of the four corners of said imaginary line, each of said standoffs having a mounting pin extending vertically from said standoff.

9. An alignment fixture of claim 7, wherein said alignment fixture further includes a support leg attached to said bottom surface of said flat base at each of the four corners of said flat base.

10. An alignment fixture of claim 8, wherein said housing of each of said jig towers has a rear wall, a pair of elongated spaced side walls and a bottom wall defining said elongated slot, said housing having an opening opposite said bottom wall and forming an exit end of said elongated slot, each of said pair of elongated spaced side walls having said front elongated surface facing towards said imaginary line, each of said side walls having an upper elongated opening therein forming a major guide track and a lower elongated opening therein forming a minor guide track, said major guide track in one of said side walls being a mirror image of said major guide track in said opposite side wall, said minor guide track in one of said side walls being a mirror image of said minor guide track in said opposite side wall, said elongated opening in each of said major guide tracks having an upper disengage section, a lower transition section and a lower engage and lock section, said elongated opening in each of said minor guide tracks having a transition section and a lower engage and lock section, said elongated bar extending within said elongated slot of said housing and having an upper section extending beyond said exit end of said housing, said elongated bar having an approximately mid-positioned pin extending therethrough whereby the opposite ends of said mid-positioned pin extend into said respective elongated openings of said major guide tracks, and said elongated bar having a lower positioned pin extending therethrough whereby the opposite ends of said lower positioned pin extend into said respective elongated openings of said minor guide tracks.

11. The alignment fixture of claim 10, wherein said elongated bar has a handle at an upper end thereof, said upper end extending externally of said housing.

12. The alignment fixture of claim 11, wherein said handle is a pin or dowel extending through said upper end of said elongated bar.

13. A modular frame for an electronic sign comprising:

an elongated top wall panel having a pair of externally spaced, vertically extending, alignment posts;

an elongated bottom wall panel parallel to and spaced from said top wall panel;

an elongated right side wall panel attached to said top and bottom wall panels;

an elongated left side wall panel attached to said top and bottom wall panels and spaced opposite to and parallel to said right side wall panel;

said elongated top, bottom, right side and left side wall panels forming a square or rectangular configuration;

a plurality of precision alignment mechanisms attached to said elongated top wall panel, said elongated bottom wall panel, said elongated right side wall panel and said elongated left side wall panel; and each of said precision alignment mechanisms including an elongated contact block with a front elongated contact surface, said front elongated contact surface extending a predetermined precise distance externally beyond each of said donated top, bottom and left and right side wall panels.

14. The modular frame of claim 13, wherein said alignment posts are tapered.

15. The modular frame of claim 13, wherein said bottom wall panel has a pair of spaced alignment holes therein.

16. A modular frame for an electronic sign comprising:

an elongated top wall panel;

an elongated bottom wall panel parallel to and spaced from said top wall panel;

an elongated right side wall panel attached to said top and bottom wall panels;

an elongated left side wall panel attached to said top and bottom wall panels and spaced opposite to and parallel to said right side wall panel;

said elongated top, bottom, right side and left side wall panels forming a square or rectangular configuration;

a plurality of latch/catch mechanisms attached to said wall panels;

a plurality of precision alignment mechanisms attached to said elongated top wall panel, said elongated bottom wall panel, said elongated right side wall panel and said elongated left side wall panel; and each of said precision alignment mechanisms including an elongated contact block with a front elongated contact surface, said front elongated contact surface extending a predetermined precise distance externally beyond each of said elongated top, bottom and left and right side wall panels.

17. A plurality of modular frames for an electronic sign, each modular frame comprising:

an elongated top wall panel;

an elongated bottom wall panel parallel to and spaced from said top wall panel;

an elongated right side wall panel attached to said top and bottom wall panels;

an elongated left side wall panel attached to said top and bottom wall panels and spaced opposite to and parallel to said right side wall panel;

said elongated top, bottom, right side and left side wall panels forming a square or rectangular configuration;

a plurality of precision alignment mechanisms attached to said elongated top wall panel, said elongated bottom wall panel, said elongated right side wall panel and said elongated left side wall panel;

each of said precision alignment mechanisms including an elongated contact block with a front elongated contact surface, said front elongated contact surface extending a predetermined precise distance externally beyond each of said elongated top, bottom and left and right side wall panels;

wherein said modular frames are adjacently arranged in both horizontal and vertical orientations such that said front elongated contact surface of each said elongated contact blocks in a given modular frame is in an abutting relationship with a corresponding front elongated contact surface of each said elongated contact blocks in said adjacently arranged modular frames whereby a precise uniform spacing is maintained between said adjacently arranged modular frames.

* * * * *